US010139195B2

(12) United States Patent
Olsen

(10) Patent No.: US 10,139,195 B2
(45) Date of Patent: Nov. 27, 2018

(54) ADJUSTABLE BUTTSTOCK

(71) Applicant: Fortis Manufacturing, Inc., Kent, WA (US)

(72) Inventor: Richard Brady Olsen, Yelm, WA (US)

(73) Assignee: Fortis Manufacturing, Inc., Kent, WA (US)

( * ) Notice: Subject to any disclaimer, the term of this patent is extended or adjusted under 35 U.S.C. 154(b) by 0 days.

(21) Appl. No.: 15/704,576

(22) Filed: Sep. 14, 2017

(65) Prior Publication Data

US 2018/0080736 A1 Mar. 22, 2018

Related U.S. Application Data

(60) Provisional application No. 62/396,446, filed on Sep. 19, 2016.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
USPC ..... 42/73
See application file for complete search history.

(56) References Cited

U.S. PATENT DOCUMENTS

| | | | | |
|---|---|---|---|---|
| 3,348,328 | A * | 10/1967 | Roy | F41C 23/04 42/73 |
| 7,162,822 | B1 * | 1/2007 | Heayn | F41C 23/04 42/71.01 |
| 8,720,099 | B1 * | 5/2014 | Sisk | F41C 23/14 42/73 |
| 9,109,855 | B1 * | 8/2015 | Kincel | F41C 23/20 |
| 9,261,324 | B1 * | 2/2016 | Liang | F41C 23/04 |
| 2003/0140542 | A1 * | 7/2003 | Kay | F41C 23/16 42/75.03 |
| 2012/0079752 | A1 * | 4/2012 | Peterson | F41A 11/02 42/75.02 |
| 2012/0151813 | A1 * | 6/2012 | Brown | F41C 7/00 42/73 |
| 2015/0345881 | A1 * | 12/2015 | Irvin | F41A 3/78 42/1.06 |
| 2016/0202016 | A1 * | 7/2016 | Mather | F41C 23/14 42/73 |

* cited by examiner

*Primary Examiner* — Samir Abdosh
(74) *Attorney, Agent, or Firm* — Eversheds Sutherland (US) LLP

(57) ABSTRACT

An adjustable buttstock may be attachable to a buffer tube with a plurality of position slots. The adjustable buttstock may include a body slidably attached to the buffer tube, a butt attached to the body, and a lever assembly rotatably attached to the body.

20 Claims, 4 Drawing Sheets

ADJUSTABLE BUTTSTOCK

CROSS-REFERENCE TO RELATED APPLICATIONS

The disclosure claims priority to and the benefit of U.S. provisional patent application No. 62/396,446, filed Sep. 19, 2016, which is incorporated by reference herein in its entirety.

FIELD OF THE DISCLOSURE

The disclosure generally relates to firearms and more particularly relates to an adjustable buttstock configured to adjust a pull length of a firearm.

BACKGROUND

Certain firearms may include a buttstock, which is typically placed against the shoulder of a user while firing. Considerations related to the design of a buttstock may include, for example, a pull length of the firearm. In some instances, the ability to adjust the buttock in order to adjust the pull length of the firearm may be desired.

SUMMARY

Some or all of the above needs and/or problems may be addressed by certain embodiments of the adjustable buttstock disclosed herein. According to some embodiments, the adjustable buttstock may be attachable to a buffer tube with a plurality of position slots. The adjustable buttstock may include a body slidably attached to the buffer tube, a butt attached to the body, and a lever assembly rotatably attached to the body.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are embodiments of an adjustable buttstock (as well as individual components of the adjustable buttstock) that can be attached to a firearm. Methods of using and installing the adjustable buttstock on the firearm are also disclosed. The firearm may be a conventional firearm. For example, the firearm may be an M-16 style rifle, an AR-15 style rifle, an AR-10 style rifle, or an M-4 style rifle, among others. Any suitable firearm may be used.

Figure 1:
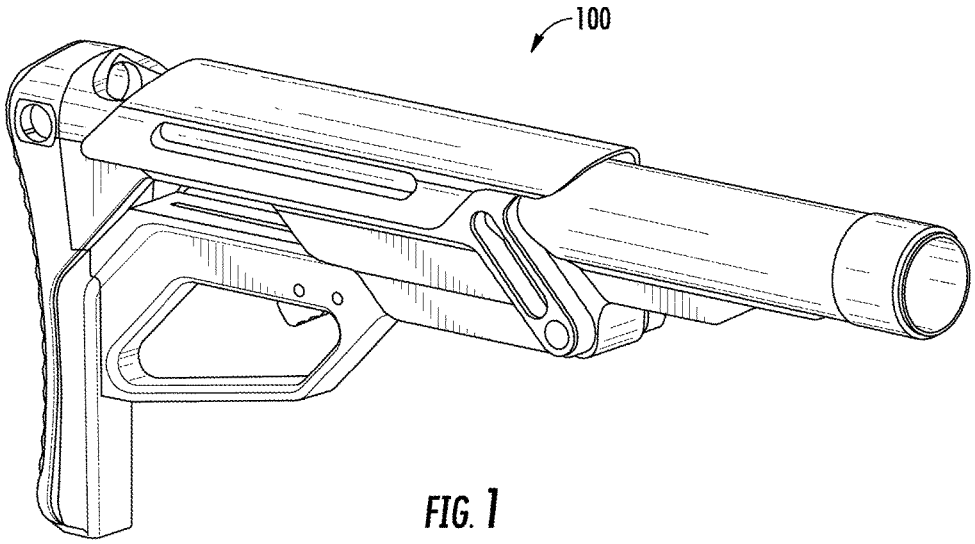
FIG. 1 depicts an upper front view of an adjustable buttstock in accordance with one or more embodiments of the disclosure.
Figure 2:
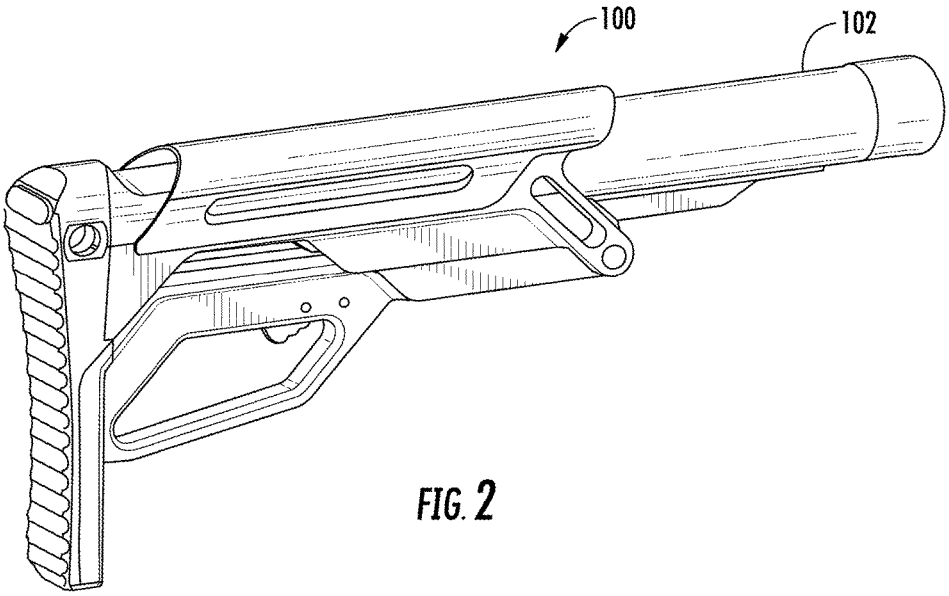
FIG. 2 depicts an upper rear view of an adjustable buttstock in accordance with one or more embodiments of the disclosure.
Figure 3:
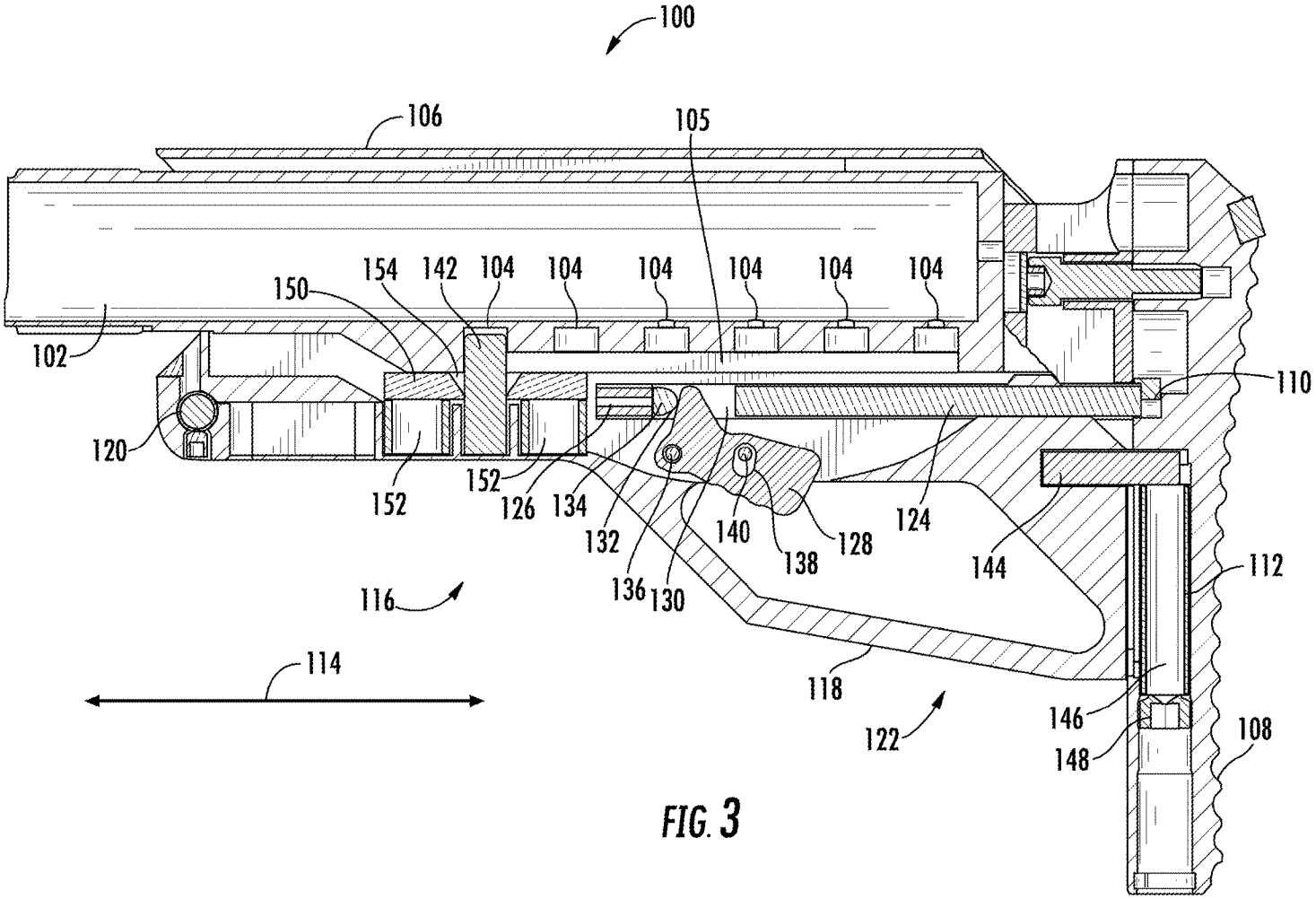
FIG. 3 depicts a sectional view of an adjustable buttstock in accordance with one or more embodiments of the disclosure.
Figure 4:
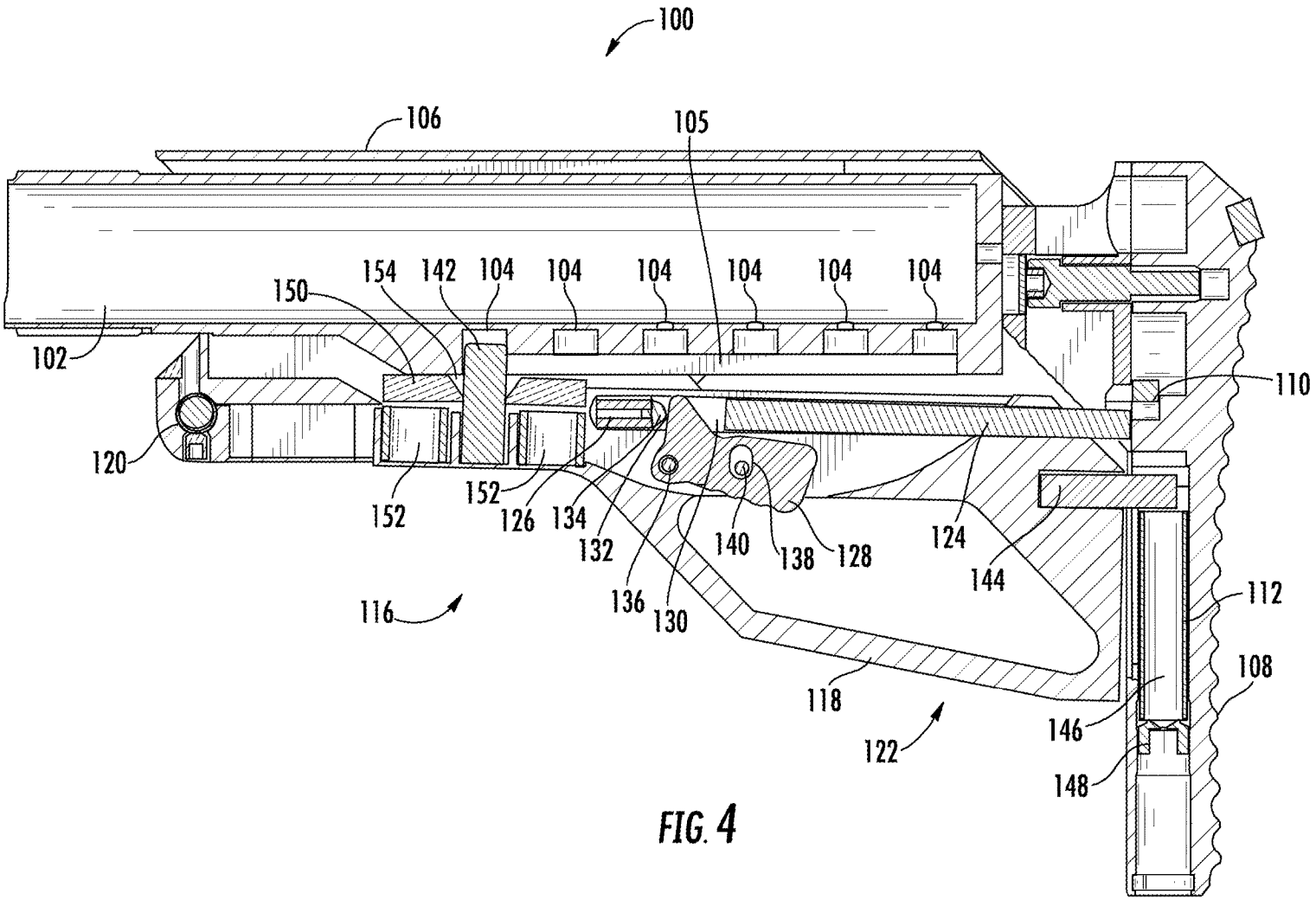
FIG. 4 depicts a sectional view of an adjustable buttstock in accordance with one or more embodiments of the disclosure.
Figure 5:
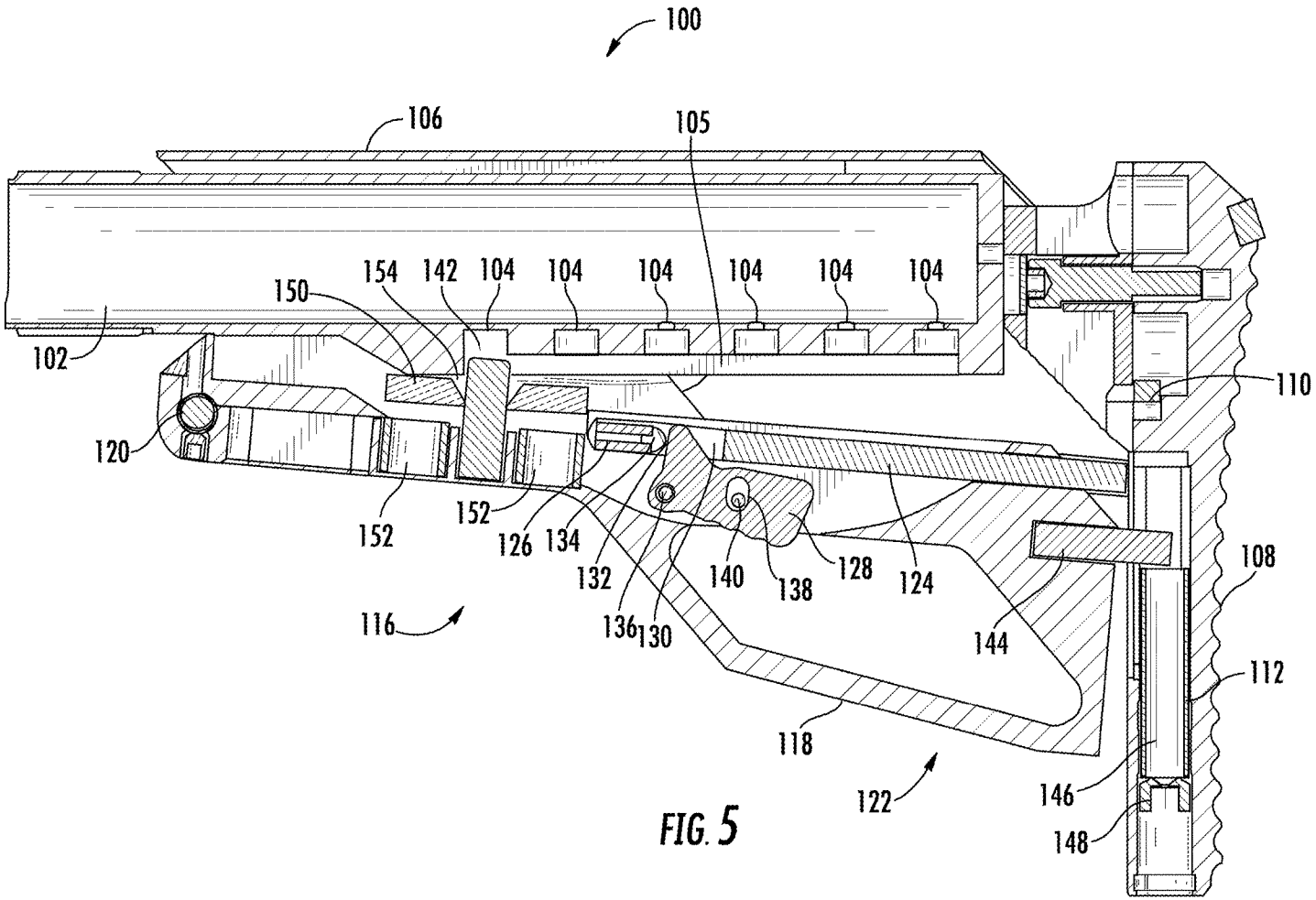
FIG. 5 depicts a sectional view of an adjustable buttstock in accordance with one or more embodiments of the disclosure.

FIGS. 1-5 depict an adjustable buttstock 100. The adjustable buttstock 100 may be attached to a buffer tube 102. The buffer tube 102 may be any suitable size, shape, or configuration. As depicted in FIGS. 3-5, the buffer tube 102 may include a plurality of position slots 104. In some instances, the position slots 104 may be axially aligned on a bottom portion of the buffer tube 102. The buffer tube 102 may include any number of positon slots 104. The position slots 104 may be any suitable size, shape, or configuration. The position slots 104 may enable the adjustable buttstock 100 to be positioned in a number of configurations along the buffer tube 102 in order to adjust the pull length of the firearm. In some instances, the position slots 104 may be located in a channel 105 on a bottom portion (e.g., the 6 o'clock position) of the buffer tube 102. In some instances, the channel 105 may be parallel to a longitudinal axis 114 of the firearm.

In some embodiments, the adjustable buttstock 100 may comprise a body 106. The body 106 may be any suitable size, shape, or configuration. The body 106 may be slidably attached to the buffer tube 102. For example, the body 106 may be disposed around the buffer tube 102 so as to telescopically extend and retract therefrom. In this manner, the body 106 may be at least partially hollow. In addition, the body 106 may include a butt 108 attached thereto. In some instances, as discussed in greater detail below, the butt 108 may include a locking slot 110 and a travel slot 112. In some aspects, the locking slot 110 may be transverse to the travel slot 112. For example, the locking slot 110 may be parallel to a longitudinal axis 114 of the firearm and the travel slot 112 may be perpendicular to the longitudinal axis 114 of the firearm.

A lever assembly 116 may be rotatably attached to the body 106. The lever assembly 116 may include a lever arm 118. In some instances, the lever arm 118 may function as a handle or the like. The lever arm 118 may be rotatably attached to the body 106 about a lever pin 120. In this manner, the lever arm 118 may be rotated. In some instances, the lever arm 118 may include a handle 122. The lever arm 118 may be any suitable size, shape, or configuration.

A locking pin 124 and a locking spring 126 may be slidably disposed within the lever arm 118. The locking pin 124 and the locking spring 126 may be any suitable size, shape, or configuration. In some instances, the locking spring 126 may bias the locking pin 128 into the locking slot 110. A trigger 128 may be attached to the lever arm 118 so as to rotatably engage the locking pin 124. The trigger 128 may be any suitable size, shape, or configuration. In this manner, rotation of the trigger 128 may overcome the spring force of the locking spring 126 to move the locking pin 124 out of the locking slot 110. For example, at least a portion of the trigger 128 may be dispose within a notch 130 in the locking pin 124, and an opposite portion of the trigger 128 may be disposed within the handle 122. The trigger 128 may include a cam surface 132 that engages a knob 134 on the locking pin 124. In this manner, rotation of the trigger 128 may cause the cam surface 132 to push the knob 134, which compresses the locking spring 126, and removes the locking pin 124 from the locking slot 110. Thus, the locking pin 124 and the locking spring 126 may slide parallel to a longitudinal axis 114 of the firearm for engaging and disengaging an end of the locking pin 124 with the locking slot 110.

The locking spring 126 may also bias the trigger 128. In this manner, when the trigger 128 is released, the locking spring 126 may push the knob 134 against the cam surface 132 to rotate the trigger 128 outward into the handle 122. At the same time, the locking spring 126 may push the locking pin 124 back into the locking slot 110. The trigger 128 may rotate about a trigger pin 136 attached to the lever arm 118. In order to limit the rotation of the trigger 128, the trigger 128 may include a trigger slot 138 and a limit pin 140 attached to the lever arm 118 and disposed within the trigger slot 138. In this manner, rotation of the trigger 128 may be limited to the length and shape of the trigger slot 138.

The lever assembly 116 may also include a position pin 142. The position pin 142 may extend from the lever arm 118. The position pin 142 may be positioned within one of the position slots 104. In addition, a travel pin 144 may extend from the lever arm 118 into the travel slot 112. A travel spring 146 within the travel slot 112 may bias the travel pin 144 (and in turn the lever arm 118) to maintain the position pin 142 in one of the position slots 104. In this manner, rotation of the lever arm 118 may overcome the spring force of the travel spring 146 to move the position pin 142 out of the respective position slot 104. Once the position pin 142 is moved out of the respective position slot 104, the body 106 may be slid along the buffer tube 102, and in turn the position pin 142 may slide along the channel 105. In some instances, a set screw 148 may be disposed within the travel slot 112. The set screw 148 may enable a user to adjust the position and compression of the travel spring 146.

In order to ensure that the lever assembly 116 is securely positioned against the buffer tube 102, a push plate 150 and one or more pressure springs 152 may be disposed within the lever arm 118. The push plate 150 and pressure springs 152 may be any suitable size, shape or configuration. The pressure springs 152 may bias the push plate 150 against the buffer tube 102. In some instances, the position pin 142 may pass through a hole 154 in the push plate 150. In some instances, the pressure springs 152 may include two pressure springs disposed on opposite sides of the position pin 142.

The lever assembly 116 may comprise a locked position, an intermediate position, and an unlocked position. For example, as depicted in FIG. 3, the lever assembly 116 is in the locked position. In the locked position, the locking pin 124 is disposed within the locking slot 110. Likewise, the position pin 142 is disposed within one of the position slots 104. The pressure springs 152 push the push plate 150 against the buffer tube 102, while the travel spring 146 provides a counteractive spring force to the pressure springs 152 to ensure that the lever assembly 116 does not move or rattle against the buffer tube 102.

As depicted in FIG. 4, the lever assembly 116 is in the intermediate position. In this position, the trigger 128 has been pulled and the locking pin 124 has been removed from the locking slot 110. The pressure springs 152 and push plate 150 push against the buffer tube 102 to slightly rotate the lever arm 118 and compressor the travel spring 146 so that the locking pin 124 is not aligned with the locking slot 110. The pressure springs 152 and push plate 150, however, do not rotate the lever arm 118 enough to disengage the position pin 142 from the respective position slot 104.

As depicted in FIG. 5, the lever assembly 116 is in the unlocked position. To get to this position, the user may rotate the lever arm 118 from the intermediate position to remove the position pin 142 from the respective position slot 104, which in turn further compresses the travel spring 146. The user can then slide the body 106 along the buffer tube 102 (and in turn slide the position pin 142 along the channel 105) to align the position pin 142 with a position slot 104. At this point, the user can let go of the lever arm 118, and the travel spring 146 will bias the lever arm 118 back to the intermediate positon, or the user can completely rotate the lever arm 118 back to the locked position, wherein the locking spring 126 will force the locking pin 124 back into the locking slot 110.

The adjustable buttstock could be made of plastic, rubber, metal, carbon fiber, composite materials, or combinations thereof. In addition, the shape of the buttstock and handle could take many forms and accomplish the same function of the lockable adjustment system. Furthermore, the trigger mechanism could be changed so that does not use the locking pin. Instead, the trigger mechanism could use a hook or latch. Furthermore, the springs could be steel, rubber, or a combination thereof. The hinge between the main body and the handle could be reconfigured in by using a pivot point or pin in track mechanism.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An adjustable buttstock attachable to a buffer tube with a plurality of position slots, the adjustable buttstock comprising:

a body slidably attached to the buffer tube;

a butt attached to the body, wherein the butt comprises a locking slot and a travel slot; and a lever assembly rotatably attached to the body, wherein the lever assembly comprises a lever arm rotatably attached to the body, a locking pin and locking spring disposed within the lever arm, wherein the locking spring biases the locking pin into the locking slot, a trigger attached to the lever arm and rotatably engaged with the locking pin, wherein rotation of the trigger overcomes the locking spring to move the locking pin out of the locking slot, and a position pin extending from the lever arm and positionable in one of the plurality of position slots.

2. The adjustable buttstock of claim 1, wherein the lever assembly further comprises:

a travel pin extending from the lever arm into the travel slot, wherein a travel spring within the travel slot biases the travel pin to maintain the position pin in one of the plurality of position slots, wherein rotation of the lever arm overcomes the travel spring to move the position pin out of one of the plurality of position slots, and a push plate and one or more pressure springs disposed within the lever arm, wherein the one or more pressure springs bias the push plate against the buffer tube.

3. The adjustable buttstock of claim 1, wherein the lever assembly comprises a locked position, an intermediate position, and an unlocked position.

4. The adjustable buttstock of claim 1, wherein the trigger rotates about a trigger pin attached to the lever arm.

5. The adjustable buttstock of claim 1, wherein the trigger comprises a trigger slot and limit pin disposed within the trigger slot that limits rotation of the trigger.

6. The adjustable buttstock of claim 1, wherein the trigger comprises a cam surface that engages a knob on the locking pin.

7. The adjustable buttstock of claim 1, wherein the at least a portion of the trigger is dispose within a notch in the locking pin.

8. The adjustable buttstock of claim 1, wherein the locking spring biases the trigger.

9. The adjustable buttstock of claim 1, wherein the lever arm rotates about a lever pin.

10. The adjustable buttstock of claim 1, wherein the lever arm comprises a handle.

11. The adjustable buttstock of claim 2, wherein the position pin passes through a hole in the push plate.

12. The adjustable buttstock of claim 2, wherein the one or more pressure springs comprise two pressure springs disposed on opposite sides of the position pin.

13. The adjustable buttstock of claim 2, further comprising a set screw disposed within the travel slot, wherein the set screw adjusts the position and compression of the travel spring.

14. An adjustable buttstock attachable to a buffer tube with a plurality of position slots, the adjustable buttstock comprising:

a body slidably attached to the buffer tube; and a lever assembly rotatably attached to the body, wherein the lever assembly comprises a lever arm rotatably attached to the body, a locking pin and locking spring disposed within the lever arm, a trigger attached to the lever arm and rotatably engaged with the locking pin, wherein rotation of the trigger overcomes the locking spring to move the locking pin, and a position pin extending from the lever arm and positionable in one of the plurality of position slots.

15. An adjustable buttstock attachable to a buffer tube with a plurality of position slots, the adjustable buttstock comprising:

a body slidably attached to the buffer tube;

a butt attached to the body, wherein the butt comprises a locking slot and a travel slot; and a lever assembly rotatably attached to the body, wherein the lever assembly comprises a locked position, an intermediate position, and an unlocked position, wherein the lever assembly comprises a lever arm rotatably attached to the body, a locking pin and locking spring disposed within the lever arm, wherein the locking spring biases the locking pin into the locking slot, a trigger attached to the lever arm and rotatably engaged with the locking pin, wherein rotation of the trigger overcomes the locking spring to move the locking pin out of the locking slot, wherein the trigger comprises a cam surface that engages a knob on the locking pin, a position pin extending from the lever arm and positionable in one of the plurality of position slots, a travel pin extending from the lever arm into the travel slot, wherein a travel spring within the travel slot biases the travel pin to maintain the position pin in one of the plurality of position slots, wherein rotation of the lever arm overcomes the travel spring to move the position pin out of one of the plurality of position slots, and a push plate and one or more pressure springs disposed within the lever arm, wherein the one or more pressure springs bias the push plate against the buffer tube.

16. The adjustable buttstock of claim 15, wherein the trigger rotates about a trigger pin attached to the lever arm.

17. The adjustable buttstock of claim 15, wherein the trigger comprises a trigger slot and limit pin disposed within the trigger slot that limits rotation of the trigger.

18. The adjustable buttstock of claim 15, wherein the at least a portion of the trigger is dispose within a notch in the locking pin.

19. The adjustable buttstock of claim 15, wherein the position pin passes through a hole in the push plate.

20. The adjustable buttstock of claim 15, further comprising a set screw disposed within the travel slot, wherein the set screw adjusts the position and compression of the travel spring.

* * * * *